US010667593B2

(12) United States Patent
Leydecker, Jr.

(10) Patent No.: US 10,667,593 B2
(45) Date of Patent: Jun. 2, 2020

(54) NECK HAIRLINE SHAVING TEMPLATE

(71) Applicant: Barry Allen Leydecker, Jr., Las Vegas, NV (US)

(72) Inventor: Barry Allen Leydecker, Jr., Las Vegas, NV (US)

( * ) Notice: Subject to any disclaimer, the term of this patent is extended or adjusted under 35 U.S.C. 154(b) by 31 days.

(21) Appl. No.: 15/197,500

(22) Filed: Jun. 29, 2016

(65) Prior Publication Data

US 2018/0000220 A1 Jan. 4, 2018

(51) Int. Cl.
*A45D 27/42* (2006.01)
*A45D 24/36* (2006.01)

(52) U.S. Cl.
CPC ..... *A45D 27/42* (2013.01); *A45D 24/36* (2013.01)

(58) Field of Classification Search
CPC ..... A45D 27/42; A45D 24/36
USPC ..... 132/213, 214
See application file for complete search history.

(56) References Cited

U.S. PATENT DOCUMENTS 999,922 A * 8/1911 Wallis ..... A45D 24/36 132/214
1,517,166 A * 11/1924 Powers ..... A45D 24/36 132/214
1,559,363 A * 10/1925 Parziale ..... A45D 24/36 132/214
1,569,452 A * 1/1926 Bradley ..... A45D 24/36 132/214
1,585,088 A * 5/1926 Delmon ..... A45D 24/36 132/214
1,629,741 A * 5/1927 Schick ..... A45D 24/36 132/214
3,407,823 A * 10/1968 Selvaggio ..... A45D 24/36 132/214
2010/0275752 A1* 11/2010 Ciccarelli ..... A45D 24/36 83/14
2014/0298964 A1* 10/2014 Eisner ..... A45D 24/36 83/13
2015/0265026 A1* 9/2015 Yeheskel ..... A45D 24/36 132/214
2016/0166040 A1* 6/2016 Chandler ..... A45D 27/00 132/213
2016/0309875 A1* 10/2016 Cover ..... A45D 24/36
2017/0027297 A1* 2/2017 Cover ..... A45D 24/36
2017/0119127 A1* 5/2017 Krost ..... A45D 27/42

* cited by examiner

*Primary Examiner* — John Villecco

(57) ABSTRACT

A neck hairline shaving template comprising of a flexing contoured body utility device with hinges, which attach to an adjustable facial strap and fastens securely around the circumference of the neck and occipital scalp over the facial chin, upper lip, or forehead. The neck hairline shaving template creates a demarcation at the natural occipital scalp hairs where it meets the neck hairline about the lower ear lobes level. The neck hairline shaving template enable the self-user without the help of others to create a desired symmetrical neck hairline with the use of a trimmer or shaver, without over trimming or shaving of the occipital scalp hairs past the templates desired parameters.

7 Claims, 4 Drawing Sheets

NECK HAIRLINE SHAVING TEMPLATE

CROSS REFERENCE TO RELATED APPLICATIONS

Not applicable

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable

STATEMENT REGARDING PRIOR DISCLOSURES BY THE INVENTOR OR A JOINT INVENTOR

Not applicable

BACKGROUND OF THE INVENTION

1. Field of the Invention

The field of the invention relates to self-user grooming device without the need for assistance from another person. A person is unable to perform task pertaining to their posterior side without requiring the constant attention from another person. A template or guide is needed if the self-user needs to remove their unwanted neck hair without the assistance of another. Neck hair generally grows faster than scalp hair leaving an undesired uneven appearance that needs frequent shaving or trimming such as a beard. Precisely and symmetrically cutting the nature shape of the scalp hair where it meets the neck hairs needs the use of a template. Once in place the neck hairline shaving template serves as a demarcation below the natural scalp hairline where the scalp hair meets the neck hair naturally about the ears level. The neck hairline shaving template once in place allows trimming or shaving of the unwanted neck. As a shaving or trimming device comes in contact with the neck hairline shaving template a demarcation of the unwanted neck hair is trimmed, cut, or shaved and the natural symmetrical pattern of scalp hairs is left intact.

2. Description of Related Art

A contoured shaped template used for symmetrically shaping, trimming or cutting unwanted neck hair. The field of the invention is to allow the self-user to precisely and symmetrically cut the nature shape of the scalp hairs where it meets the neck hairs.

BRIEF SUMMARY OF THE INVENTION

A neck hairline shaving template is put against the back of the neck and secured around the head, pressurized by the flexing contoured body via an adjustable strap support, applied by the self-user. The neck hairline shaving template enables the self-user without the help of others to create a desired smooth neck hairline with the use of a shaver, trimmer, razor, or scissors without over shaving or cutting of the hair past its desired parameters.

DETAILED DESCRIPTION OF THE INVENTION

Neck hair has a natural transition of occipital scalp hairs meeting the neck hairs about the lower ears level on the posterior neck. The occipital scalp hair has a natural horizontal chord across the circumference of the posterior neck and curves as desired symmetrically towards the left and right ear about the ear lobes level.

A neck hairline shaving template enables the self-user to create a desired symmetrical neck hairline demarcation. Once the neck hairline shaving template is in place a snug and contoured fit, holds the guide in place securely and hands free. The self-user then can shave, trim, or cut their unwanted neck hair with the use of a trimmer or shaver without over trimming or shaving of the hair past the templates desired parameters.

The device has hinges extending laterally off the templates support bridge distancing the hinges from the utility device body. The support bridge height allows trimming of whole natural curvature of the occipital neck hair, trimming underneath an adjustable facial strap do to the support bridge elevation. The utility device body flexes for contoured fitting to the occipital posterior neck. As a shaving or trimming device comes in contact with the neck hairline shaving template a demarcation of the unwanted neck hair is trimmed, cut, or shaved and the natural symmetrical pattern of scalp hairs is left intact.

Figure 1:
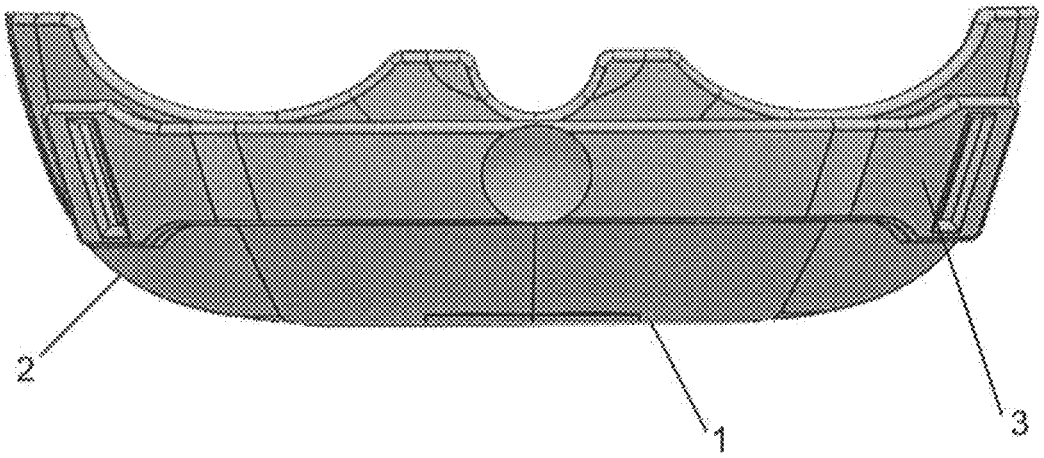
FIG. 1 is a front view of the neck shaving template.

FIG. 1 is a front view of a neck hairline shaving template having 1 guide line which creates a horizontal chord across the posterior neck. 2 contoured radius curves naturally towards the left and right ear. 3 hinge projecting off support bridge.

Figure 2:
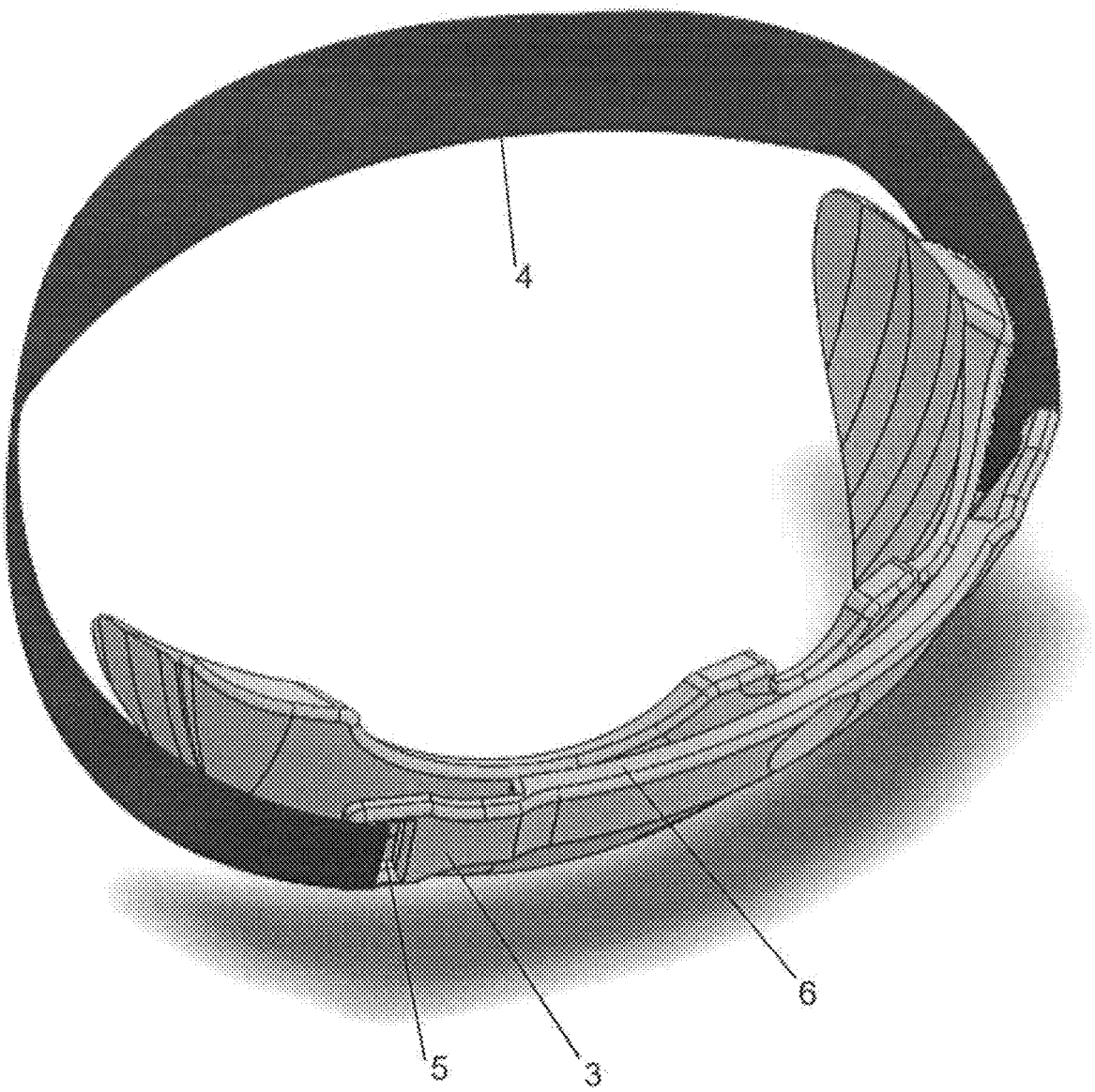
FIG. 2 is an ISO elevational view of a neck hairline shaving template.

FIG. 2 is an ISO elevational view of a neck hairline shaving template having 4 adjustable facial strap. 5 slotted hole for adjustable strap attachment. 6 support bridge. 3 hinge projecting off support bridge.

Figure 3:
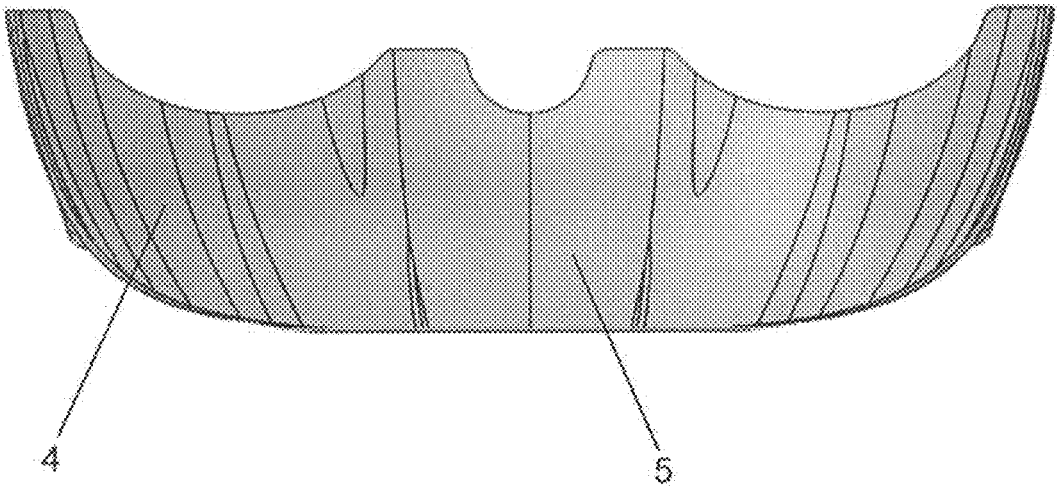
FIG. 3 is a back view of the shaving template.

FIG. 3 is a back view of a neck hairline shaving template having 4 flexing contour body fitting to the occipital posterior neck. 5 Contoured utility body protects scalp hair.

Figure 4:
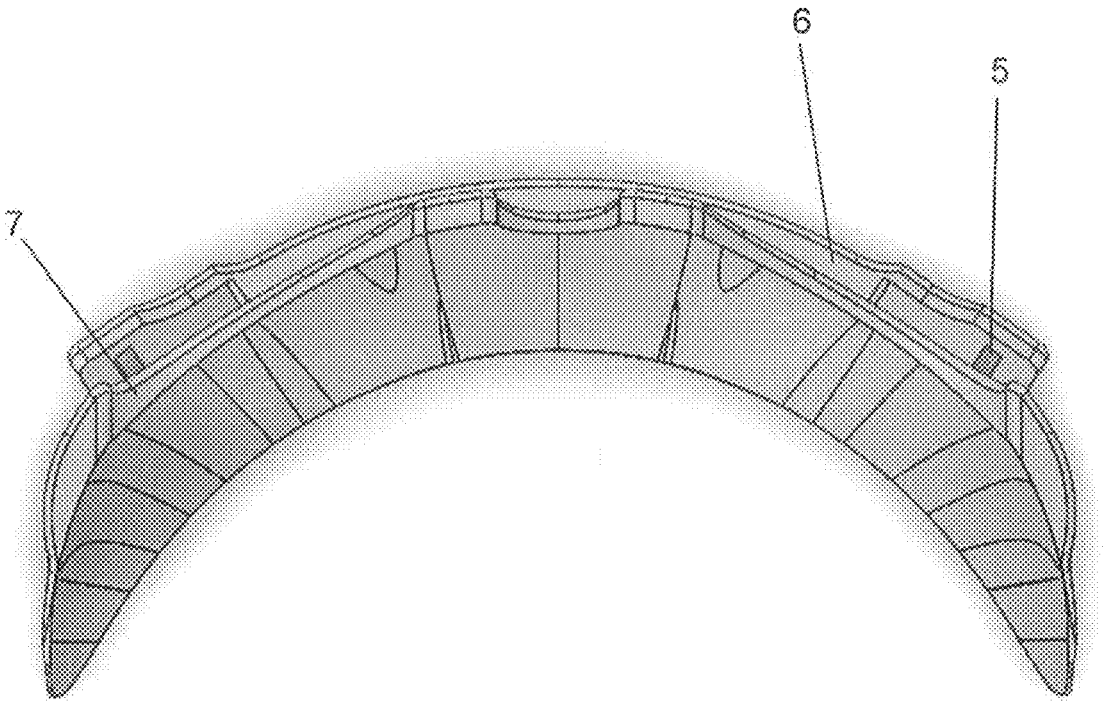
FIG. 4 is a top elevational view of a neck hairline shaving template.

FIG. 4 is a top view of a neck hairline shaving template having 7 elliptical circumference of the posterior neck. 5 slotted hole for adjustable strap attachment. 6 support bridge.

The invention claimed is:

1. A neck hairline shaving template, comprising:

a flexing contoured body that is pre-formed in a elongated shape having a bottom surface for contact with an individual's head when the neck hairline shaving template is worn and a top surface opposite the bottom surface;

the contoured body has an elevated support bridge attached to the top surface of the flexing contoured body;

the elevated support bridge has at least two attaching lateral strap hinges;

the strap hinges each have at least one slotted hole opening;

the at least one slotted hole opening is attached to one adjustable strap for securing around the individual's head, wherein the elevated support bridge distances the strap hinges from the flexing contoured body.

2. The neck hairline shaving template according to claim 1, wherein:

the elongated shape of the flexing contoured body forms an elliptical contour of an occipital scalp of the individual's head and it takes a circumferential shape of a posterior neck of the individual's head while wearing the neck hairline shaving template.

3. The neck hairline shaving template according to claim 2, wherein:

the elongated shape of the contoured body creates a surface guide of a horizontal chord with a predetermined contoured radius curving towards a left and right ear of the individual's head across a circumference of the posterior neck of the individual's head while wearing the neck hairline shaving template.

4. The neck hairline shaving template according to claim 3, wherein: the surface guide creates a demarcation guideline of occipital scalp hair from neck hair of the individual's head while wearing the neck hairline shaving template.

5. The neck hairline shaving template according to claim 3, wherein: the strap hinges allow trimming underneath the adjustable strap and along the surface guide because of the distance created by the support bridge.

6. The neck hairline shaving template according to claim 1, wherein: the flexing contoured body is comprised of a flexible material to take a shape of a circumferential posterior neck of the individuals head while wearing the neck hairline shaving template.

7. The neck hairline shaving template according to claim 1, wherein: the strap hinges laterally extend off the support bridge.

* * * * *